United States Patent [19]

Matyas

[11] 4,011,702

[45] Mar. 15, 1977

[54] BUILDING WALL CONSTRUCTIONS

[76] Inventor: Andrew M. Matyas, 1642 North Road SE., Warren, Ohio 44484

[22] Filed: Apr. 18, 1975

[21] Appl. No.: 569,371

[52] U.S. Cl. ..... 52/387; 52/389

[51] Int. Cl.[2] ..... E04C 5/18; E04F 13/08

[58] Field of Search ..... 52/386, 387, 388, 502, 52/390, 519, 675, 674, 389

[56] References Cited

UNITED STATES PATENTS

| | | | |
|---|---|---|---|
| 421,741 | 2/1890 | Marsh | 52/387 |
| 421,742 | 2/1890 | Marsh | 52/387 |
| 658,868 | 10/1900 | Rosenbaum | 52/387 |
| 777,656 | 12/1904 | Banning | 52/386 |
| 1,014,157 | 1/1912 | Lewens | 52/675 X |
| 1,850,961 | 3/1932 | Mortenson | 52/387 |
| 1,857,490 | 5/1932 | Barrett | 52/502 |
| 1,947,418 | 2/1934 | Kahn | 52/675 X |
| 1,982,560 | 11/1934 | Williams | 52/387 |
| 2,852,932 | 9/1958 | Cable | 52/387 X |
| 3,444,660 | 5/1969 | Feichter et al. | 52/309 |
| 3,533,206 | 10/1970 | Passeno, Jr. | 52/387 |
| 3,594,968 | 7/1971 | Johnson | 52/390 |

FOREIGN PATENTS OR APPLICATIONS

| | | | |
|---|---|---|---|
| 712,127 | 7/1966 | Italy | 52/387 |
| 1,212,833 | 11/1970 | United Kingdom | 52/387 |
| 790,495 | 2/1958 | United Kingdom | 52/519 |

*Primary Examiner*—Alfred C. Perham
*Attorney, Agent, or Firm*—Michael Williams

[57] ABSTRACT

A building construction for fabricating a veneer, facing wall on a building wall. The construction includes a flat panel of thin rigid material that is adapted to be secured to the building wall. The panel has a plurality of spaced parallel ridges which form flat-bottomed troughs therebetween. Veneer building blocks are held in the troughs by use of adhesive and these blocks may be spaced and staggered to provide the appearance of a conventional brick wall. Crosspieces are held in the troughs between adjoining ends of adjacent blocks. The ridges and crosspieces have exposed surfaces to provide the appearance of mortar between the veneer blocks.

4 Claims, 8 Drawing Figures

BUILDING WALL CONSTRUCTIONS

BACKGROUND AND SUMMARY

The prior art includes many constructions for holding the wall, floor or ceiling tile or blocks to a panel which in turn is secured to a building support. Included in such art are panels having a plurality of spaced parallel ribs, but the latter are utilized to provide dove-tail joints to lock the tiles or blocks in place, and are hidden from view. Other prior art includes a mat for mounting tiles, but the mat in this case is a molded affair to provide block-like sockets, each socket receiving one tile.

My improved construction lends itself well to modern, high-production methods in the formation of the component parts and when the building blocks are set inplace, provides the appearance of a professionally-made wall of conventional construction.

The wall construction of my invention includes a flat panel of thin, rigid material which has a plurality of spaced parallel ridges, the latter providing flat-bottomed troughs therebetween. The veneer building blocks are of a predetermined length, and of a width to fit within a trough without covering the ridges defining the trough. The panel may have a paint finish thereon so that the exposed surfaces of the ridges provide the appearance of mortar.

As a further feature of my invention, a plurality of identical crosspieces are used for disposition between adjoining ends of adjacent building blocks to properly space such blocks and to provide the appearance of mortar therebetween. In some of the prior art, actual mortar, or a mortar-simulating compound fills the space between adjacent blocks and, just like conventional mortar, this discolors with age and is difficult to clean. In my improved construction, the ridges and crosspieces give the appearance of mortar and, since the exposed surfaces of these parts are coated, such as with baked enamel, it is very easy to wipe such surfaces clean.

DESCRIPTION OF THE DRAWINGS

In the drawings accompanying this specification and forming a part of this application, there is shown, for purposes of illustration, an embodiment which my invention may assume, and in these drawings.

DESCRIPTION OF THE PREFERRED EMBODIMENT

Figure 1:
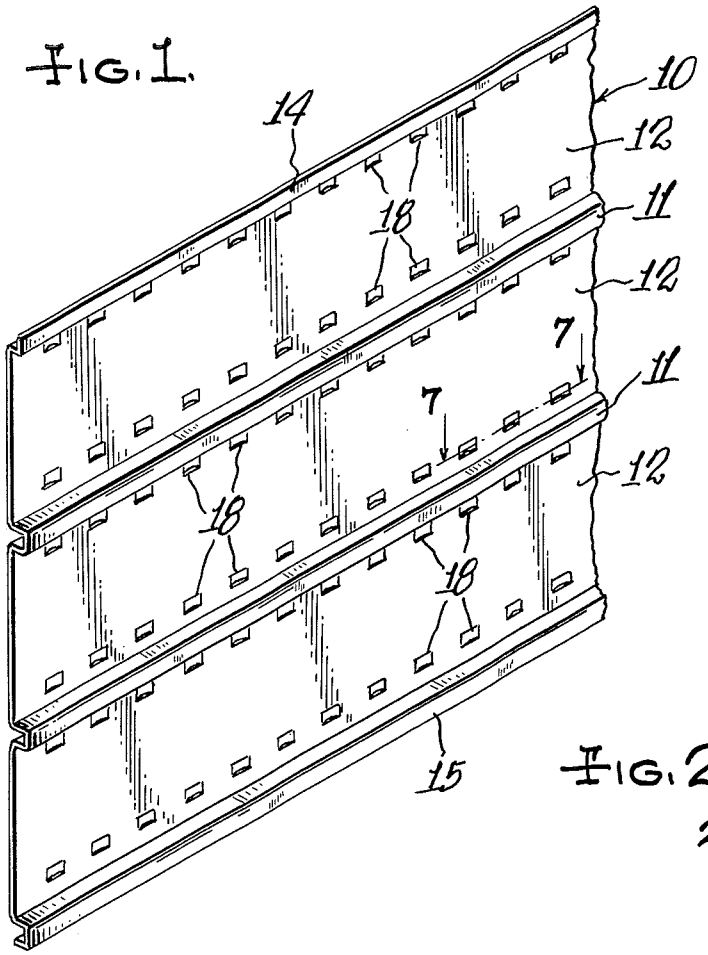
FIG. 1 is a fragmentary, perspective view of a panel forming part of the preferred embodiment of my invention.

FIG. 1 shows a panel 10 forming part of my invention. This panel is formed of any suitable thin, rigid material, such as metal or plastic. Sheet metal is presently preferred since it may be obtained in thin sheets and may be readily worked. Because of its resistance to corrosion and the fact that it may be readily deformed by conventional forming tools, aluminum sheeting has been found desirable.

Figure 7:
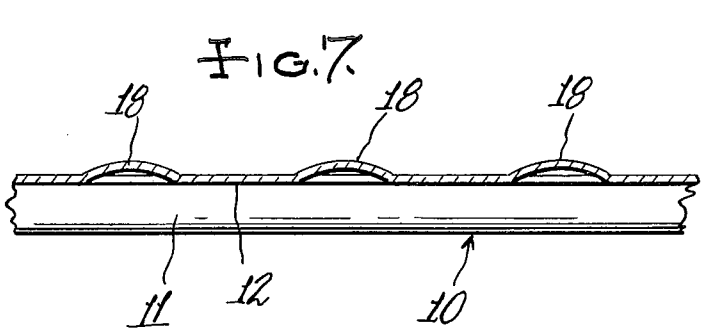
FIG. 7 is an enlarged, fragmentary sectional view corresponding to the line 7—7 of FIG. 1.
Figure 8:
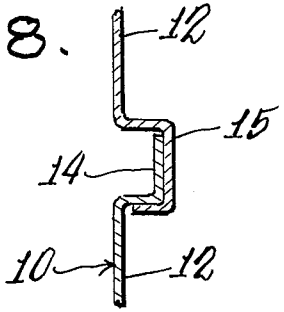
FIG. 8 is an enlarged, fragmentary sectional view showing the interconnection between adjoining margins of a pair of panels.
Figure 2:
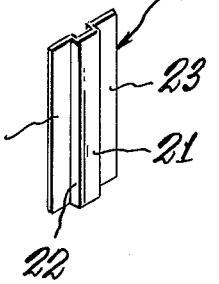
FIG. 2 is a perspective view of one of the plurality of crosspieces used in my improved construction.

As shown in the drawings, the panel has a plurality of spaced, parallel ridges 11, forming flat-bottomed troughs 12 therebetween. One longitudinal edge of the panel is formed with an angular lip 14 while the other longitudinal edge of the panel is formed with a hook-shaped lip 15 which is adapted to fit over the angular lip 14 of an adjoining panel, as seen in FIG. 8, to provide a resultant ridge similar to the ridges 11. The panel 12 may be of any desired length, and at present I find it preferable to form panels in lengths of 8 feet. A plurality of panels may be joined, longitudinal edge to longitudinal edge, in the manner shown in FIG. 8, to cover a wall of a depth greater than a single panel 10.

The ridges 11—11 and the lips 14 and 15 may be formed in a flat metal strip by a conventional roll-forming machine and the width of the panel may be dictated by the capacity of the machine. Thus, in large roll-form machines, more than two ridges 11—11 may be formed and the size shown in FIG. 1 is considered a preferred minimum size.

Figure 4:
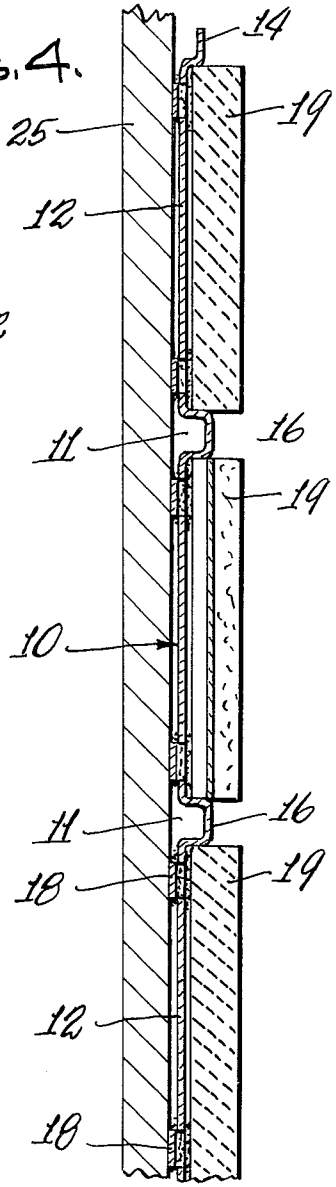
FIG. 4 is an enlarged sectional view corresponding to the line 4—4 of FIG. 3.
Figure 5:
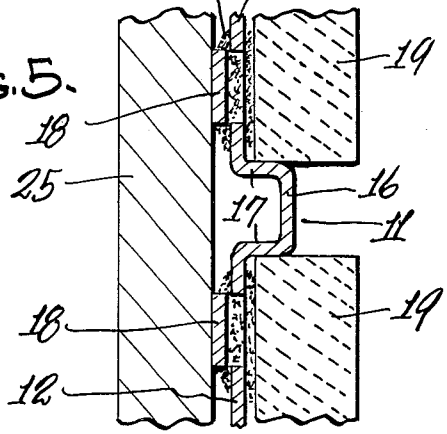
FIG. 5 is a sectional view of a portion of the construction shown in FIG. 4, but drawn to a further enlarged scale to better illustrate details.

As best seen in FIGS. 4 and 5, the ridges 11—11 are U-shaped in cross-section with a bight 16 and legs 17 substantially at right angles to the bight and the intermediate flat-bottomed trough 12. A series of lanced portions 18 are formed in each trough, along a line spaced inwardly of a ridge 11 (or lips 14–15), and these lanced portions may be formed at the same time the ridges 11 and lips 14–15 are formed. After the panel is formed, opposite surfaces may be coated with paint to simulate the color of mortar. In the case of aluminim panels, and to conserve paint and labor, only the finally exposed surface of the panel may be painted.

The panel 10, or a plurality of panels, are secured to a wall support 25 which may take any suitable form. In new home constructions, plywood or cellutex, or both, are nailed over the studding to form the wall support. In older homes, plywood may be nailed over the siding to provide the support. In any case, the panel or panels 10 are nailed or stapled as shown at 26, to the wall support.

A plurality of building blocks 19, commercially available, are used in combination with the panel. These blocks are preferably identical and may be formed to simulate tile, or preferably brick as shown in the drawings. The blocks are rectangular in plan, and may be square, or preferably oblong as shown. Commercially available blocks have longitudinal and transverse edge surface which are substantially square with the opposite side block surfaces and these fit in well with the panel construction.

Figure 3:
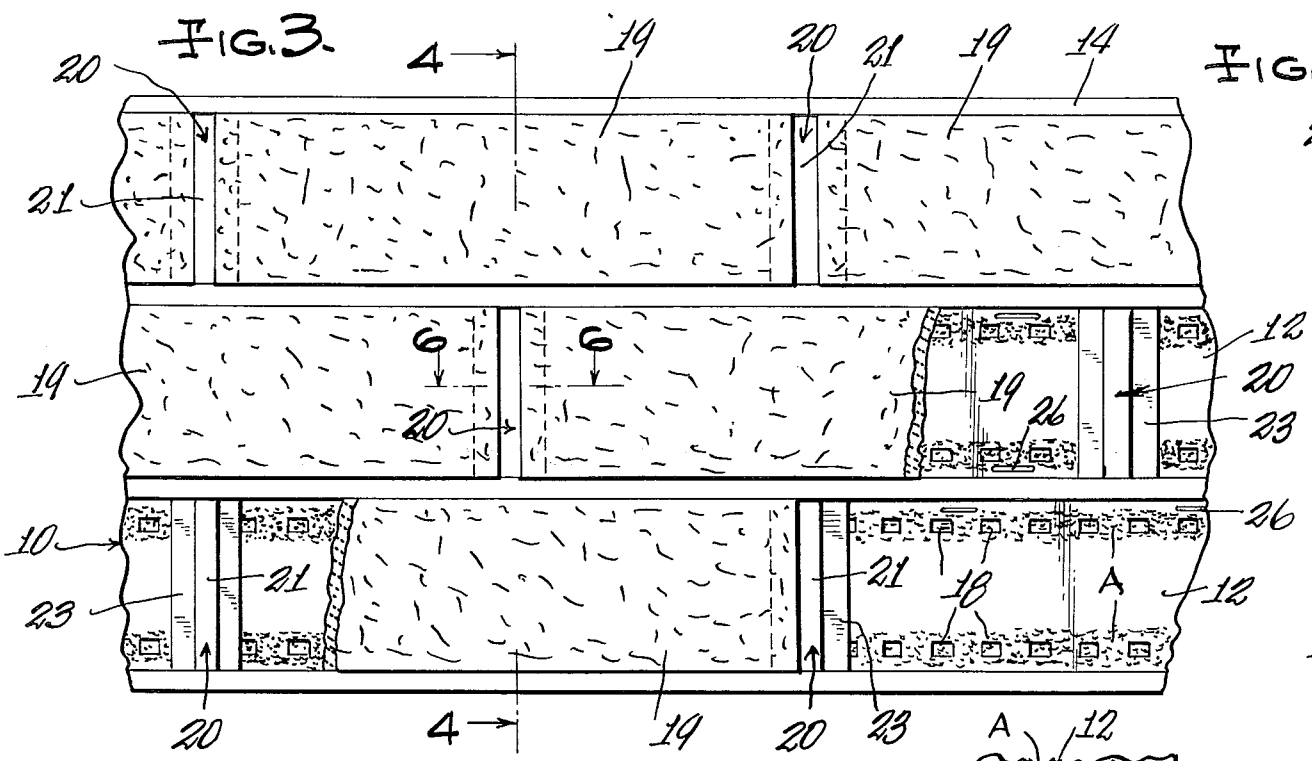
FIG. 3 is a fragmentary, plan view of completely fabricated veneer wall facing, parts being broken away to show underlying construction.

As seen in FIGS. 3, 4 and 5, the distance between adjacent ridges (which defines the width of the trough therebetween) is substantially equal to the width of a block so that the latter fits fairly snugly between such ridges and thus leaves only the exterior surface of a bight 16 exposed to simulate mortar between the blocks.

To firmly and permanently secure the blocks 19 within the troughs, a suitable adhesive A is used. One type found suitable is a sealant manufactured and sold by the B. F. Goodrich Company. This adhesive A may be applied by a caulking gun along a line inwardly of the ridges 11—11 (or the lips 14–15) as seen in FIG. 3, and preferably over the lanced portions 18. The blocks 19 are then successively pressed into place within the troughs 12 to evenly spread the adhesive and force it into the lanced portions 18. The blocks 19 therefore present a flush exterior appearance, as seen in FIG. 4 with the adhesive locked into and behind the lanced portions.

Adjoining edges 19.1 of adjacent blocks 19 may be spaced by eye to indicate the normal spacing between brick blocks. However, it is preferred to utilize crosspieces 20 to provide uniform spacing. Each crosspiece may be formed of the same material as the panel and therefore may be rolled or extruded in long lengths and then cut to size to fit within a flat bottomed trough and closely at right angles between ribs 11 forming the trough, as seen in FIG. 3.

Figure 6:
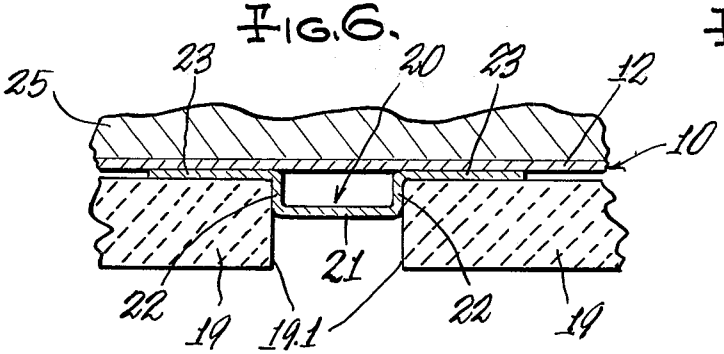
FIG. 6 is an enlarged, fragmentary, sectional view corresponding to the line 6—6 of FIG. 3.

Each crosspiece is hat-shaped in cross-section, as best seen in FIG. 6, to provide a U-shaped center piece having a bight 21 and legs 22–22 extending at right angles to the bight and to side webs 23—23. As the successive blocks 19 are pressed into place, a crosspiece 20 is interposed between adjoining edges of adjacent blocks to properly space the same. The thickness of the webs 23 is absorbed by the plastic adhesive so as not to materially affect the flush appearance of the wall formed by the blocks 19. Thus, both the blocks 19 and the crosspieces 20 are held in place by the adhesive. The crosspieces are preferably painted the same color as the panel, so that the exposed surfaces of the bights 21 provide the appearance of mortar.

I claim:

1. A building construction for fabricating a veneer facing wall, comprising:

a flat panel formed of thin, rigid material, said panel having pairs of spaced parallel ridges co-extensive with the longitudinal length thereof and forming a flat-bottomed trough between each pair, each ridge being U-shaped in cross-section to form a bight and legs extending at right angles from said bight and integrally joined at right angles with an adjoining trough portion, a plurality of veneer building blocks, each formed as a rectangular slab of a predetermined length and of a width to fit flatwise within a trough and closely but freely and without interference fit between bight legs of adjacent ridges, said blocks being of a thickness at least equal to the depth of a trough so that outer faces of said blocks are exposed, and with the bights of said ridges exposed between said blocks, the bottom of each trough having a series of lanced-out portions along a line but inward of each ridge, each lanced-out portion providing a lip displaced from the inner surface of said trough and projecting from an outer surface of the same, and each lip being aligned with the opening formed in the Lancing operation, adhesive material between the inner face of each of said blocks and the inner surface of a said trough for holding said building blocks in place, said adhesive material being applied in layer form along the line of and over said lanced-out portions to interlock with the same, and said building blocks being assembled with said panel by pressing individual blocks into a said trough and against said adhesive to urge some of the latter through the openings formed by the lanced-out portions, said displaced lips providing a stop for said adhesive material to restrain it from falling from the outer surface of said trough.

2. The construction according to claim 1 and further including a plurality of crosspieces of thin, rigid material, each having a U-shaped cross section substantially similar to the shape of said ridges, and being of a length to fit crosswise at right angles between adjacent ridges and of a depth to seat in a said trough with the legs thereof in abutment with facing edges of adjoining blocks and the bight thereof spanning said facing edges to simulate mortar.

3. The construction according to claim 2 wherein each of said crosspieces has angular portions extending laterally outwardly from the terminal portions of respective legs, said angular portions being disposed between a said trough and inner face portions of said adjoining blocks and said crosspieces being held in place by said adhesive.

4. The construction according to claim 1 wherein said panel has an angular lip coextensive with one longitudinal margin in spaced relation and parallel to a ridge at said margin, and a U-shaped lip coextensive with the opposite longitudinal margin in spaced relation and parallel to a ridge at said opposite margin, the angular lip of one panel interfitting with the U-shaped lip of another panel to provide the appearance of a ridge.

* * * * *